United States Patent [19]

Swallert

[11] Patent Number: 4,463,876

[45] Date of Patent: Aug. 7, 1984

[54] MEASURING DEVICE

[75] Inventor: Sven A. Swallert, Geneva, Switzerland

[73] Assignee: NPI New Products Investment AB, Askim, Sweden

[21] Appl. No.: 305,640

[22] PCT Filed: Jan. 23, 1981

[86] PCT No.: PCT/SE81/00014

§ 371 Date: Sep. 21, 1981

§ 102(e) Date: Sep. 21, 1981

[87] PCT Pub. No.: WO81/02094

PCT Pub. Date: Aug. 6, 1981

[30] Foreign Application Priority Data

Jan. 24, 1980 [SE] Sweden ..... 8000562

[51] Int. Cl.[3] ..... G01F 11/02

[52] U.S. Cl. ..... 222/94; 222/96; 222/185; 222/207; 222/214; 222/448; 222/450; 222/83

[58] Field of Search ..... 222/448–452, 222/183-185, 206, 207, 212–214, 556, 557, 544, 545, 96, 94, 95, 180, 181, 129, 425, 80–83, 182

[56] References Cited

U.S. PATENT DOCUMENTS 3,768,704 10/1973 Béguin ..... 222/207
3,926,347 12/1975 Low et al. ..... 222/185
4,349,133 9/1982 Christine ..... 222/183

FOREIGN PATENT DOCUMENTS 2414323 10/1979 France ..... 222/449

*Primary Examiner*—Joseph J. Rolla
*Assistant Examiner*—Kevin P. Shaver

[57] ABSTRACT

A measuring device for dispensing preferably viscous liquids comprising a container (4) for the liquid with a main space (28) and below the main space, a smaller space (29) which is in communication with the main space through a passage (37) and opens out through another passage (30). The portion which constitutes the smaller space (29) and the two passages (37, 30) is compressible. A member (3) is adapted, under the influence of spring forces, in a first position to compress the second passage (30). The member can be moved, against the action of said spring forces, into a second position in which it compresses the first passage (37) while the second passage (30) is open, so that in a third position, in which the member compresses the smaller space (29) and still the first passage (37), the liquid squirts out through the second passage (30). The measuring device comprises a first portion (1) which is intended to be mounted fixed and a second portion (2) which is adapted to be able to be displaced towards and away from the first portion (1) , the container (4) being adapted to be fitted between the first and second portions. The member (3) is supported between the two portions in such a manner that when the second portion is uninfluenced the member is held in its first position and when the second portion (2) is moved towards the first portion (1), the member (3) assumes the second and the third position in turn. The second portion has the form of a hood over the container (4) which is of soft material in which the passages (37, 30) and the spaces (28, 29) are formed.

3 Claims, 6 Drawing Figures

MEASURING DEVICE

TECHNICAL FIELD

The present invention relates to a measuring device for dispensing preferably viscous liquids and comprising a container for the liquid having a main space and a smaller space which is below the main space and is in communication with the main space through a passage and opens through another passage. The part which constitutes the smaller space and the two passages is compressible. A member is adapted to compress the second passage under the influence of spring force, in a first position. Against the action of said spring force, the member can be brought into a second position in which it compresses the first passage while the second passage is open, so that in a third position, in which the member compresses the smaller space with continued compression of the first passage, the liquid squirts out through the second passage while at the same time the flowing back of the liquid through the first passage to the larger space is prevented.

BACKGROUND ART

Measuring devices of the kind indicated are often intended for portioning out washing agents such as soap solution for washing the hands and body. Such devices are often used in nursing. In this case it is important to meet high hygienic demands which indicates the use of throw-away containers and a portioning out device of a once-only character. As a result, said parts are replaced at uniform intervals, in time with the consumption of the washing agent, which reduces the need for maintenance and reduces the risk of the growth of bacteria. With devices used in nursing it is also important that the manipulation during the portioning out should be as simple as possible with the control member of such a construction that manipulation can take place with the elbow so that the control member does not need to be touched by the hand.

From the publication of the Swedish Patent Application No. 7603865-2, a two-chamber pack is known for dispensing liquids in determined doses. This pack comprises a relatively complicated valve construction and therefore, if it is made as a throw-away pack, the pack encumbers the product with a relatively high cost while it must require complicated tool equipment for its manufacture.

THE TECHNICAL PROBLEM

The object of the present invention is to provide a measuring device which is suitable for use in connection with a throw-away pack and which, through its simplicity, can involve a low price and which can be manufactured in a simple manner.

One problem, which is also to be solved by the present invention, is to provide a simple and practical manipulation possibility for the device.

THE SOLUTION

The solution, which is indicated by the invention consists in that the liquid container is formed like a soft bag which is provided with passages and chambers in such a manner that these parts form the liquid-carrying part of the measuring member which is completed by other members which do not come into contact with the liquid. Furthermore, in the invention, a hood is designed as a control member.

ADVANTAGES

As a result of the fact that the bag-shaped throw-away container for liquid is fashioned with the liquid-carrying measuring member, this is also replaced as soon as the liquid is used up, as a result of which a satisfactory hygiene is maintained in comparison with devices in which the measuring mechanism is never replaced during the life of the device, while at the same time a very simple construction is obtained through the division of the member into liquid-carrying and non-liquid-carrying parts. As a result of the fact that the hood is used as an external control member no separate control member need to be provided but an integration of covering and control member is obtained. At the same time, the member becomes easily manipulated as a result of a large surface in comparison with conventional buttons, levers and the like.

BRIEF DESCRIPTION OF DRAWINGS

The accompanying drawings show two forms of embodiment of the invention which is described below. In the drawings.

BEST MODE OF CARRYING OUT THE INVENTION

Figure 1:
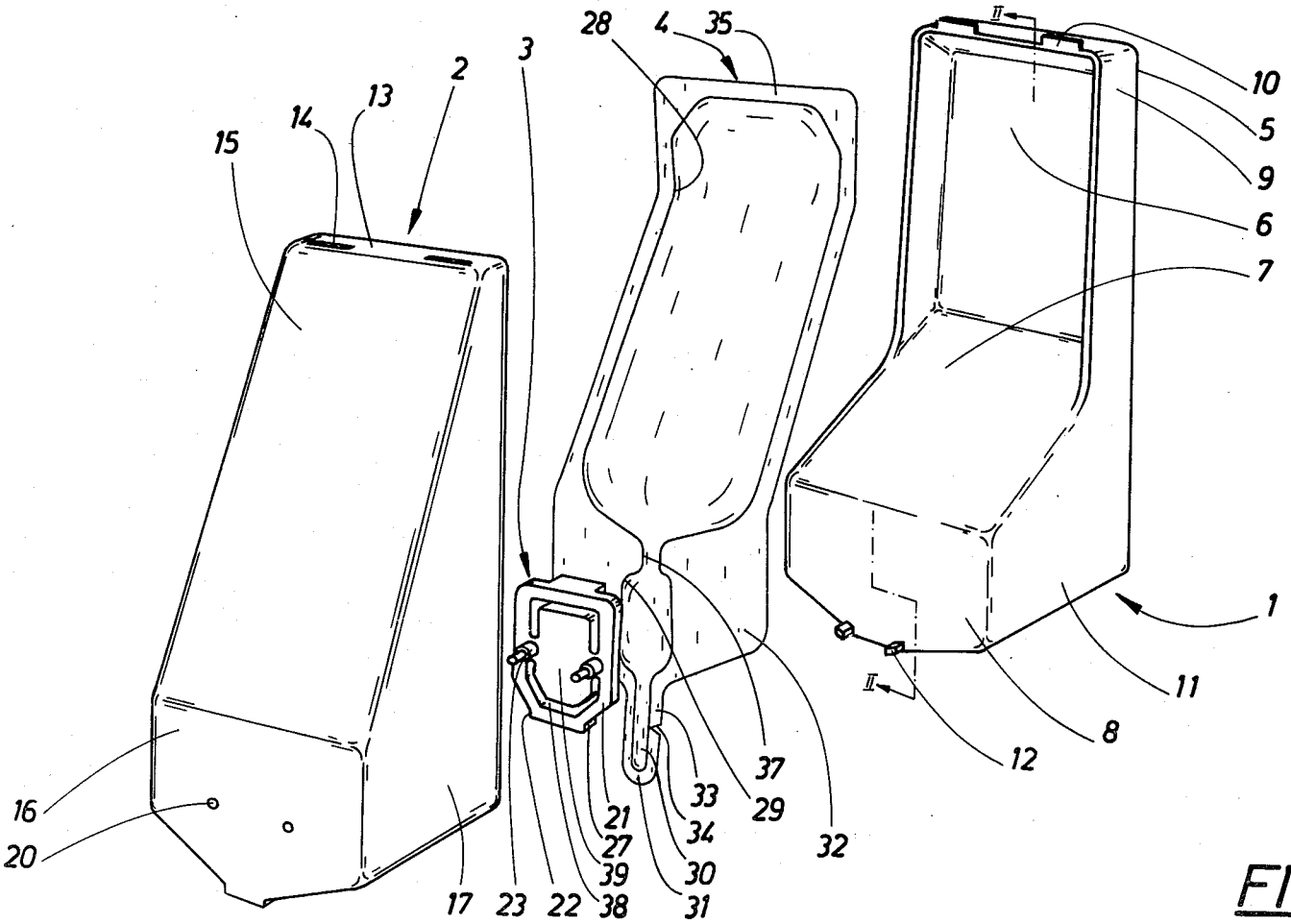
FIG. 1 shows the device according to the first example in an exploded view.
Figure 2:
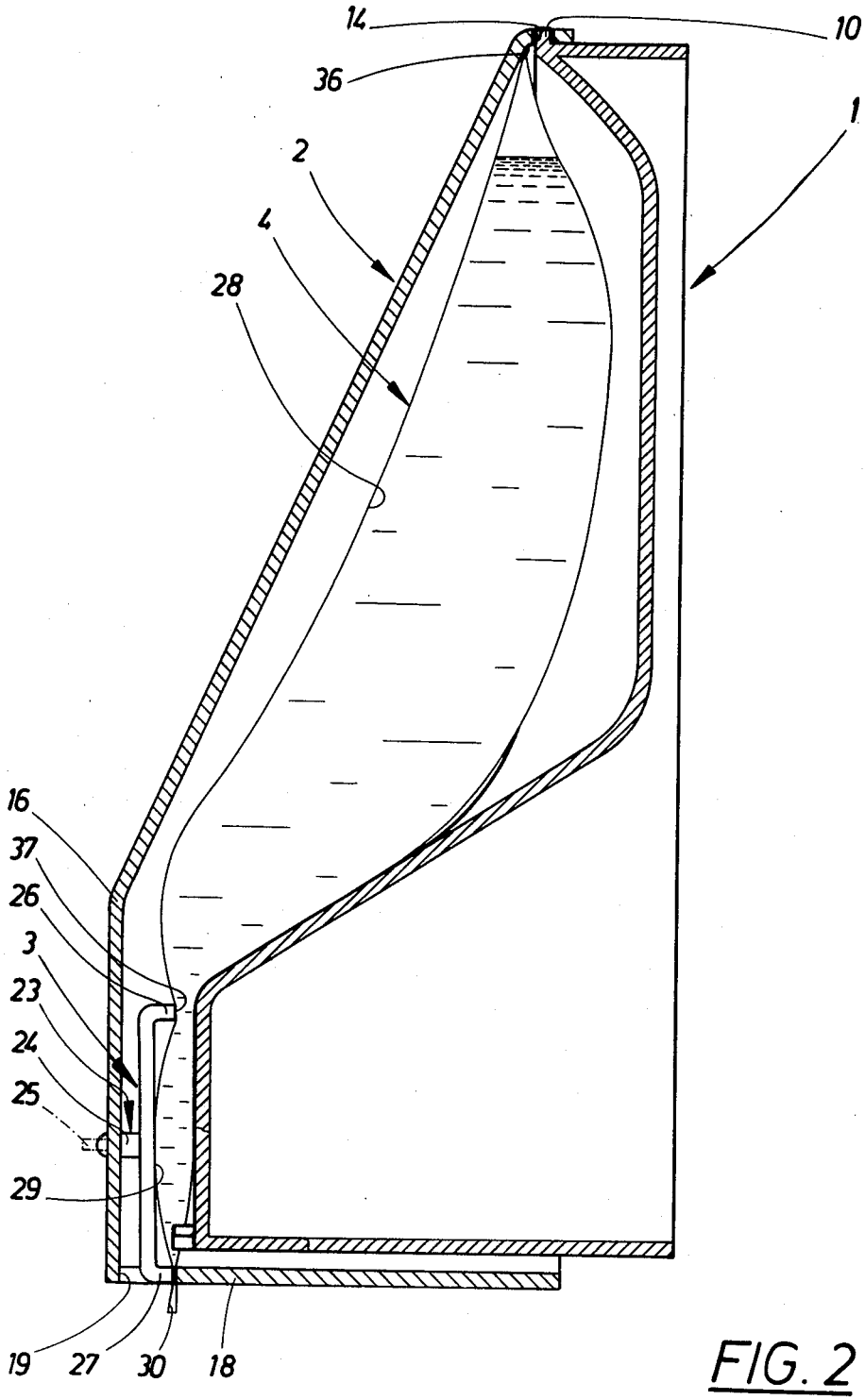
FIG. 2 shows a section through the device on the line II—II in FIG. 1.

According to FIGS. 1 and 2, the device according to the first example of embodiment comprises a first part or frame 1 which is adapted to be installed on a vertical surface, for example a wall, a second part or hood 2, and a member or plate 3 fixed to the inside of the hood (see FIG. 2, in FIG. 1 the plate 3 is separated from the hood 2 for the sake of clarity) and a soft container bag 4 which is adapted to contain the medium intended to be measured out, a usual viscous liquid, such as soap solution or hand cream. The frame 1 is intended to be permanent and may appropriately be made of hard plastics. The hood 2 with its plate 3 and the bag 4 are intended to constitute a unit of throw-away character. Thus it is delivered with the bag 4 filled with the medium in question and is intended to be disposed when the bag is empty. The hood 2 may appropriately be made of thin but stiff plastics, for example vacuum-formed, the plate 3 is made of resilient hard plastics preferably in an injection-moulding process and the bag 4 may appropriately be made of plastics foil and be produced by welding two layers of plastics together along the contours of the bag.

The frame 1 comprises a back 5 which is adapted to be fixed to the vertical surface by means of a two side adhering adhesive tape or by screws. The front of the frame 1 comprises at the top a plane 6 parallel to the back, an inclined portion 7, and a projecting lower plane 8 substantially parallel to the back and having a first and middle support surfaces. The plane 6 is surrounded at the top and at the sides by a projecting frame 9 from the upper portion of which two tenons 10 extend upwards. The lateral portions of the frame 9 merge into side walls 11 which are connected to the inclined portion 7 and the lower plane 8. The lower plane 8 comprises two bosses or resting members 12 between which is formed a central portion of the lower plane 8.

The hood 2 comprises an upper end wall 13 with two openings 14 which are adapted to be able to be threaded over the tenons 10 on the frame 1. The upper end wall 13 is continued in a front with a portion 15 inclined forwards and downwards and a portion 16, which is vertical in the suspended position, with two holes 20. At the sides, the upper end wall 13 is continued in side walls 17 which are connected by a bottom wall 18 with a slot-shaped opening 19 (see FIG. 2) close to the front portion 16. All the walls in the hood 2 are relatively thin and the cavity formed inside the hood is completely open towards the back. The opening formed is thus surrounded by the upper end wall 13, the side walls 17 and the under side 18.

The plate 3 comprises a main or middle portion 21 with a lower narrowed portion 22 which is so wide that it can cover the bosses 12 in the frame 1. At one side, the main portion 21 comprises two carrying members or pins 23 with an inner wider portion 24 and an outer, narrower portion 25 (see FIG. 2). The narrower portion 25 of the two pins 23 fits into the holes 20 in the hood 2 and the plate is adapted to be secured in the hood by riveting of the pins 23 as can be seen from FIG. 2. At the opposite side, the main portion 21 comprises an upper edge or boss 26 and a lower edge or boss 27. Thus these bosses are turned inwards towards the back of the hood. In the plate there are two grooves 38 which facilitate its bending and which bound a central portion 39.

In the fixed position in the hood 2, the plate 3 rests with its lower boss 27 against the inner edge of the opening 19 in the hood. The inner edge serves as a second support surface for the plate 3. The resilience in the material of the plate and also to some extent of the hood is, however, such that the plate can be swung out from said edge against the spring pressure.

The container bag 4 comprises an upper, larger space 28 and a lower, smaller space 29, which spaces are united by a passage 37. Extending downwards from the space 29 is a passage 30 which comprises a portion 31 closing the same. Thus the whole of the internal space 28–30 is closed and is adapted to contain the medium in question which is to be measured out. The external contours of the bag 4 substantially follow the boundary of the internal space apart from the fact that the smaller container 29 is surrounded by a skirt 32. The passage 30 is situated in a narrow projecting portion 33 which is provided with a weakened tearing portion 34 where the part 33 can be torn off so that the passages 30 is opened. The bag 4 is adapted to be secured, by its upper edge 35 to the upper end wall 13 of the hood 2, for example by a welding seam 36 (FIG. 2).

Figure 5:
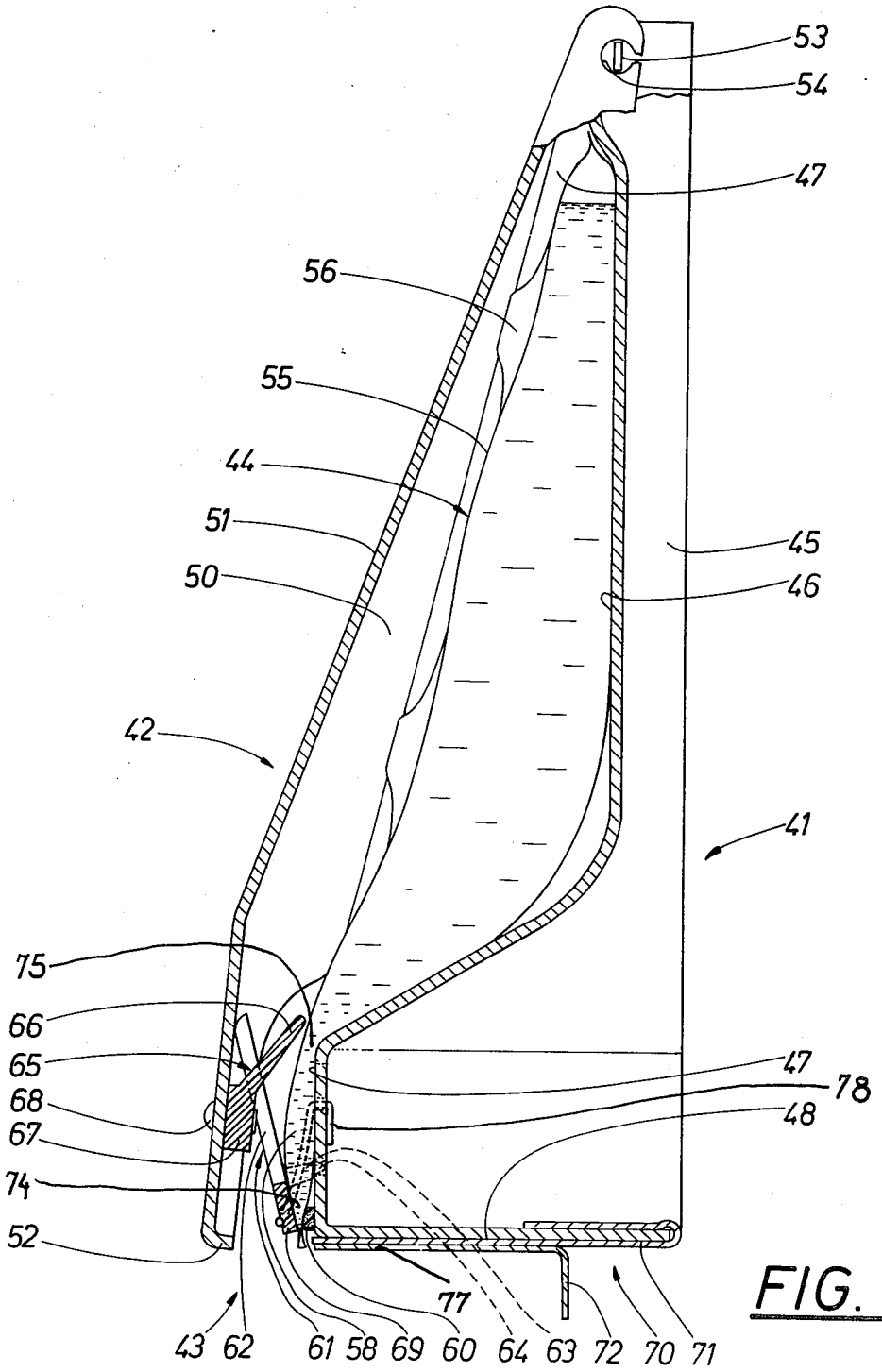
FIG. 5 shows the device according to the second example in a section on the line V—V in FIG. 6.
Figure 6:
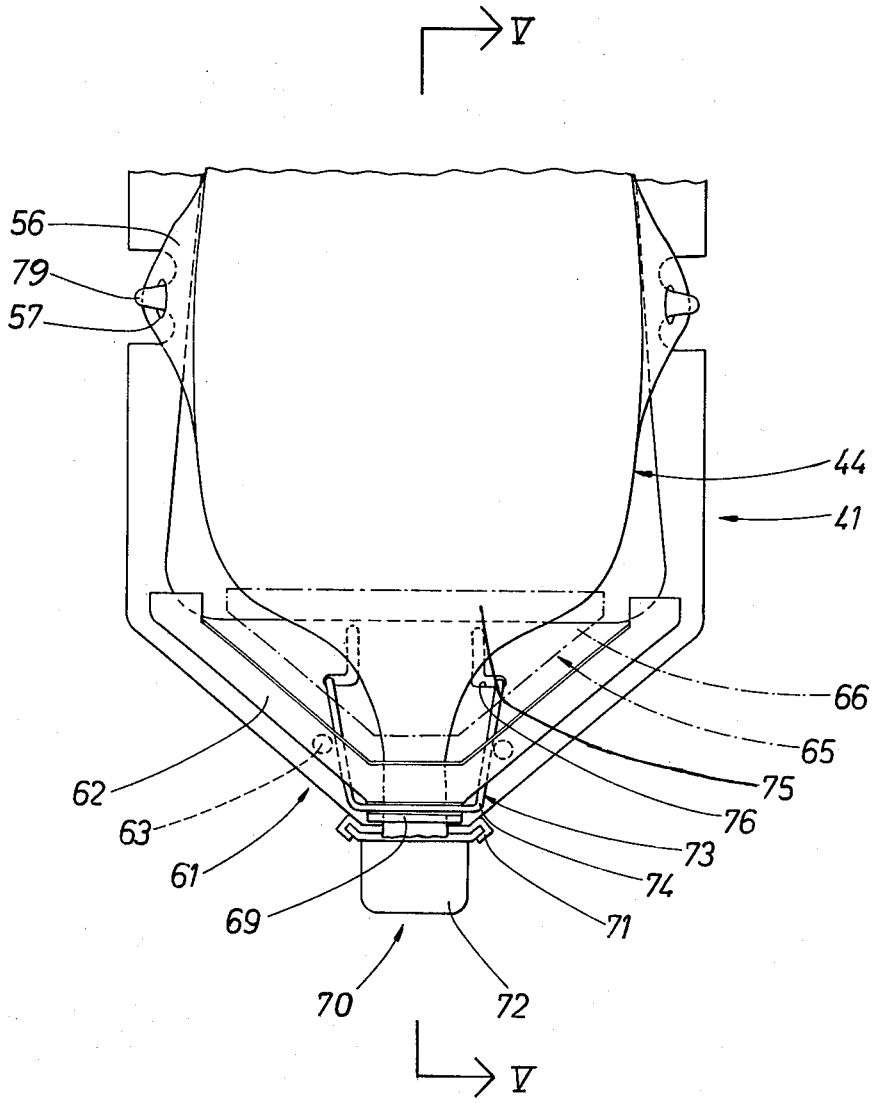
FIG. 6 shows a part of the device in front view.

The measuring device according to the second form of embodiment is shown in FIGS. 5 and 6 and consists mainly of the same functional parts as the first form of embodiment but somewhat differently arranged. Thus there is a rigid first part, a frame 41, which is adapted to be installed on a vertical surface, a second part, a hood 42, and a soft container bag 44 for the medium. Disposed at the lower end of the parts 41, 42 is a measuring device 43 in which the lower portion of the container bag 44 is also included.

The frame 41 comprises two side walls 45 and sunk between these side walls a compartment 46 for the main portion of the container bag 44 while between the lower portions of the side walls 45 a plane 47 is disposed at the same height as the side walls, against which plane the lower portion of the container bag can bear on. The frame 41 is terminated at the bottom by a lateral portion 48 extending between the side walls and united to the plane 47.

The hood 42 in turn comprises two side walls 50 which lie outside the side walls 45 and a front portion 51. The front portion 51 ends at the bottom with a slightly bent-in edge 52. The side walls 45 of the frame 41 have, at their upper edge, on the outside, rectangular pins 53, the long sides of which are parallel to the back of the frame 41. Immediately in front of the pins, the side walls 50 of the hood 42 are provided with round holes 54 each of which is open towards the back of the hood through a narrow slit. This slit is adapted to be able to be threaded over the respective pin 53 so that, in the position shown in FIG. 5, this can act as a pivot pin for swinging of the hood.

The container bag 44 is assumed to be made of two plastics foils welded together at the edges and as in the first form of embodiment is functionally divided into a main space 55 in the upper portion and in the lower portion a first passage 75, a smaller space 58 and a second passage 74 which, during use, is adapted to open outwards so that liquid can be discharged. As seen from FIG. 6, the passage 75 extends over a relatively wide portion of the bag which then becomes narrower so that the space 58 has a substantially triangular shape. The passage 74 extends through the narrow end portion of the bag. In order to ensure leakage-free storage, this end portion may appropriately be closed by an extension which is welded together but which is shown cut away in the Figures.

Disposed at the edges of the main space 55 are wings 56, two at each side with holes 57. These holes 57 are adapted to hook over pins 79 on the frame 41 so that the bag is supported as a result. Thus, in this case, both the frame 41 and the hood 42 are intended to be permanent while the container bag 44 is of throw-away character and it can easily be replaced through its suspension on the pins 48.

The measuring device 43 has various elements distributed on the parts described above. Thus the frame 41 carries, on the lower edge of the plane 47, a soft strip 60 of rubber for example. Furthermore, the plane 47 carries a first pivotable element 61 which, as shown in FIG. 6, comprises two wings 62 which are united in a central portion with a lower portion or edge 69. The element 61 rests against the plane with two pins 63 which are guided by narrow end projections 64 in holes in the plane 47. The edge 69 is urged against the resilient strip 60 by means of a U-shaped spring 73 which is held to the plane 47 by means of folded-over portions 78 which extend through L-shaped grooves 76 in the plane. The upturned portions of the grooves 76 can be used during mounting for passage of the folded-over portions 78. The portion of the container bag 44 which contains the passage 74 should be squeezed between the edge 69 and the resilient strip 60 by the action of the spring 73.

A further element 65 of the measuring device 43 is fixed to the hood 42 by means of a rivet 68. The element 65 has the form of a triangular wing of which the tip, the inner portion 67, is turned downwards and secured to the inside of the hood by means of the rivet 68 and of which the base, the outer portion 66, is turned upwards and swings outwards from the inside of the hood. The member 65 is of resilient material, preferably plastics.

As mentioned, it is assumed that the container bag 44 has a closed end portion which must be cut away. For this purpose, a cutting mechanism 70 is disposed on the frame 41. It consists of a fixed rail 71 which is held by a portion folded over towards the inside of the frame while the main portion of the rail is at the outside of the end portion 48 of the frame. The rail 71 is constructed in the form of a slide for a movable knife 72. The knife has a folded down handle portion and on its main portion has a hole 77 with sharp edges.

As can be seen from FIG. 2 and as previously stated, with the first form of embodiment, the unit formed by the hood 2, the plate 3 and the bag 4, which are connected to one another, is intended to be mounted on the frame 1 as a result of the fact that the openings 14 are threaded over the pins 10. In this position, the bag rests with its upper portion against the plane 6 and the inclined portion 7 of the frame 1 while the lower portion 32 rests against the vertical portion 8 of the frame 1 and is below the plate 3 above which, in turn, is the portion 16 of the hood 2 which hides the whole bag 4 and the frame 1 apart from the edges of the latter. Nevertheless, the narrow termination 33 of the bag extends out through the opening 19 in the under side 18 of the hood 2. The frame 1, on the other hand, is assumed to be permanently mounted on a vertical surface, for example a wall surface, for example close to a wash-basin. Because of its weight, the unit tends to be pressed inwards against the lower portion of the frame 1 in the suspended position. In this case, the plate rests with the lower portion above the boss 27 against the bosses 12. The tension in the material, which tends to urge the boss 27 against the inner edge of the opening 19 in the hood 2 is so great, however, that the elongated portion 33 of the bag 4 is squeezed together with a certain force between said elements so that the passage 30 is squeezed despite the pressure from the bosses 12. The position is shown in FIG. 2.

After installation, before the device is taken into service, the outer portion of the elongated portion 33 of the bag 4 should be torn off, which is facilitated by the tear initiation 34. As a result of this, the passage 30 is opened. Nevertheless this does not lead to any outflow of the medium in the bag 4 since the part 33 is compressed by the boss 27. In the position described, the boss 26 on the plate 3 is at a distance from the portion 8 on the frame 1 and the passage 37 is thus open.

Figure 3:
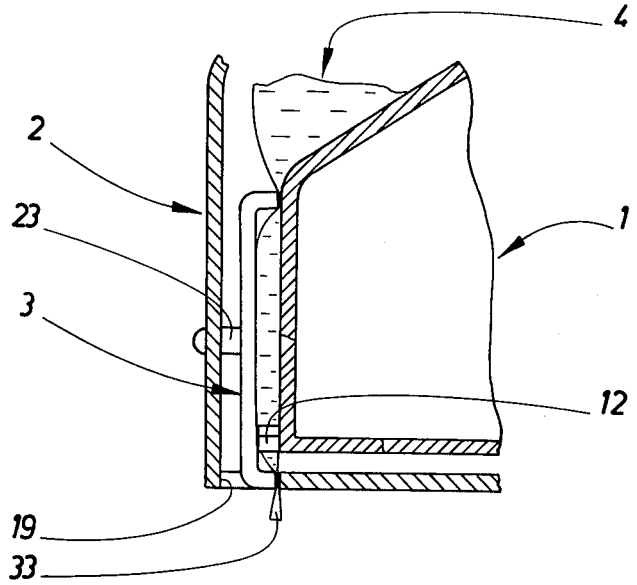
FIGS. 3 and 4 show, in partial section, corresponding to the section in FIG. 2, two further operating states of the device.
Figure 4:
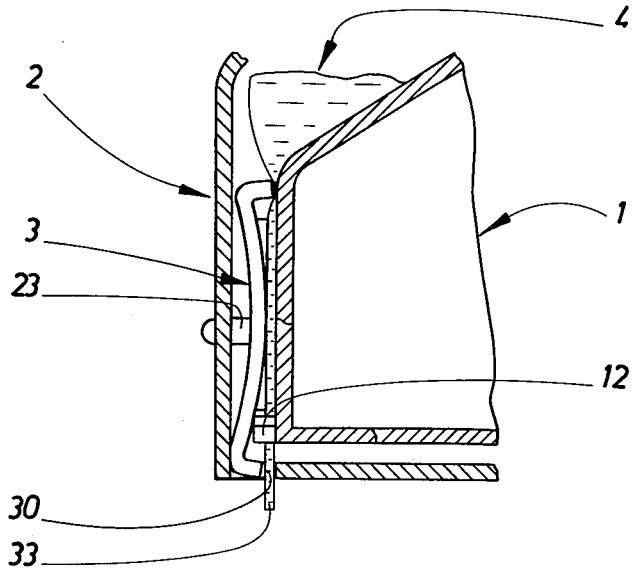

When a quantity of the contents of the bag 4 is to be measured out, the hood 2 is pressed inwards, preferably by pressing against the vertical portion 16 of the hood, so that it pivots about the pins 10. Under the first pressing-in moment, the plate 3, which is supported against the bosses 12 by its lower edge and which is pressed inwards in its central portion by means of the hood 2 via the pins 23, comes to swing with springing of the hood, so that the upper projection 26 compresses the bag 4 opposite the passage 37. This position is shown in FIG. 3. With continued pressure against the hood, the plate 3 can no longer swing since it rests with its two ends against the portion 8 on the frame 1 or against its bosses 12, which leads to the fact that the pressure via the pins 23 bends the plate 3 so that its central portion is pressed inwards. This central portion then presses against the bag 4 opposite the smaller space 29. During the movement, the lower portion 18 of the hood 2 has simultaneously swung inwards, as a result of which the inner edge of the opening 19 has moved away from the projection 27 on the plate 3 since this cannot accompany the inward movement because the projection is resting against the bosses 12. As a result the squeezing of the passage 30 ceases while at the same time the smaller space 29 is compressed while the passage 37 is compressed by the projection 26. This position is shown in FIG. 4. The said state leads to the fact that the contents of the smaller space 29 are at least mainly pressed out through the passage 30 and the intention then is that the dose pressed out should be caught by the hand which is held under the dependent portion 33 of the bag 4. The pressing out of the dose thus takes place forcibly, which is important with a viscous medium such as a thick soap solution or a hand cream.

When the hood 2 is released, the said material tensions tend to straighten out the plate 3 and to swing it into the position shown in FIG. 2 in which it is supported against the bosses 12. In the course of this, the plate becomes free so that the projection 27 can swing in against the one edge of the opening 19 in the container 2 and the part 33 with the pressure 30 is clamped shut again. At the same time, the passage 37 is opened and medium can run down from the large space 28 and again fill the smaller space 29 through the passage 30. Even if the medium is viscous, this takes place because, as a result of its upper suspension, the bag tends to be compressed and creates a certain liquid pressure. Apart from this, the refilling of the space 29 can be allowed to take some time. In the smaller space 29, the size of which is limited so that a correct dose may be obtained, the pressure conditions are less favourable, however, and at the same time there is a demand that the dose should be obtained immediately when the hood 2 is pressed in, so that the forcible pressing out of the dose is necessary for emptying the lower space 29 but not for refilling it. As a result of the fact that the bag 4 is made of soft material, it can collapse as the medium therein diminishes and as a result no air intake opening is needed. This is important with high hygienic demands because the need to let in air could lead to contamination of the medium. When the bag 4 is completely empty the intention is that the unit containing it should be exchanged for a new unit, as indicated previously.

During charging of the device shown in FIGS. 5, 6 with a container bag, the hood 42 is swung out about the pins 53 so that the slit in the hole 54 faces straight downwards. The hood can now be lifted up off the pins 53. The compartment 46 then becomes accessible and a container bag 44 can by hung by its holes 57 over the four pins 48. By pressing on one of the wings 62 of the element 61, the edge 69 can be caused to swing outwards from the strip 60 so that the lower portion of the container bag with the passage 74 can be inserted between the edge 69 and the strip 60.

In the state in which it is delivered, the container bag 44 is completely closed, as stated, and it terminates at the passage 74 with an extension. In order that the contents may be squirted out, this extension must be cut off and, as stated, the displaceable knife 72 is provided for this purpose. It is thus pushed outwards whereupon the extended portion of the bag is dragged against the top of the knife until it falls down in the hole 77. Now the knife 72 is pulled back and the sharp edge of the hole then cuts off the outermost end of the bag against the end of the rail 71 so that the passage 74 is opened.

After this, the hood 42 is replaced by pushing its holes 54 over the pins 53, after which the hood is lowered into the position shown in FIG. 5. In this position, the passage 74 is still closed. The spring force against the element 61 holds the hood in the position shown so long as it is not acted upon. When liquid is to be measured out, the lower portion of the hood is pressed inwards so that it pivots about the pins 53. In the course of this, the outer portion 66 of the element 65 compresses the portion of the bag where the passage 75 is situated against the plane 47. At the same time, the passage 74 begins to open as a result of the fact that the element 61 swings outwards with its lower edge under the action of the hood. With continued pressing in, the outer portion 66 of the element 65 recedes further back and its portion 67 is pressed against the portion of the bag between the two passages 74 and 75 which contains the smaller space 58 of the bag. When the space 58 is compressed, the enclosed liquid is pressed out of the space and since the passage 75 is closed while the passage 74 is open, the liquid is thus forcibly squirted out through the opening situated at the very bottom of the bag. The quantity of liquid should then be caught—if it is soap solution—by the hand. If the hood is now released, it returns as a result of the pressure from the element 61 into the original position shown in FIG. 5. In the manner described, specific doses of the liquid can be measured out compulsorily even if the liquid should be very viscous or even paste-like. As the liquid is used up, the container bag 44 collapses and thus no air need be introduced therein. When the bag is empty, it can be removed and replaced by a new one in the manner described.

I claim:

1. A measuring device for dispensing liquids, preferably viscous liquids, comprising: a collapsible container made of a generally soft material for the liquid, said container including a main space and a measuring chamber being of smaller volume than and being arranged below said main space, a first passage providing communication between said main space and said measuring chamber, and a second passage extending from said measuring chamber; a resilient movable member having a first position compressing a portion of the container which includes said second passage while keeping the container substantially uninfluenced at a portion which includes said measuring chamber and said first passage, a second position compressing a portion of the container which includes said first passage with continued substantial compression of said second passage while keeping a portion of said container which includes said measuring chamber substantially uninfluenced, and a third position compressing a portion of said container which includes said measuring chamber with continued compression of the portion which includes said first passage while keeping a portion which includes said second passage substantially uninfluenced, so that liquid squirts out through said second passage while at the same time flow of liquid through said first passage back into said main space is prevented; a first part forming a frame for mounting said container, and a second part displaceable towards and away from said first part, said second part forming a hood which substantially encloses said container, said member being arranged between said two parts in such a way that when said second part is in a normal position said member is held in its first position and when said second part is displaced in a direction towards said first part said member will be sequentially moved to its second and third positions, said member consisting of a plate including a first edge section positioned adjacent said first passage and a second edge section positioned adjacent said second passage and a middle portion between said edge portions and positioned adjacent said measuring chamber, said plate being carried by carrying means on one of said parts so as to be pivotable about said middle portion; first, second, and middle support surfaces, respectively, opposite said first edge section, second edge section, and said middle portion of said member, said member being capable of compressing portions of the container against said support surfaces; resting means for said member on the other part, said member being positioned to rest on said resting means between said middle portion and said second edge section; said member being movable to said first position to compress a portion of the container including said second passage against said second support surface, said second position under the influence of a movement of said second part to compress a portion of the container including said first passage against the first support surface, and said third position after a further movement of said second part to rest on said resting means and to be pivoted by pressure on said middle portion of said carrying means resulting in a swing out of said second edge portion from said second support surface thereby opening said second passage and a compression of said measuring chamber by said middle portion of said member against said middle support surface when said plate bends towards said middle support surface under the pressure from said carrying means while resting on its first edge section and on said resting means.

2. A measuring device as claimed in claim 1, in which said carrying means consists of a narrow section connecting said plate and said part carrying said member so that said pivoting of said member will occur under bending of said narrow section.

3. A measuring device as claimed in claim 2, in which said member is carried by said second part by means of said narrow section, said first and middle support surfaces being positioned on said first part and said second support surface being positioned on said second part.

* * * * *